US008311246B2

(12) United States Patent
Akino

(10) Patent No.: US 8,311,246 B2
(45) Date of Patent: Nov. 13, 2012

(54) MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 384 days.

(21) Appl. No.: 12/700,232

(22) Filed: Feb. 4, 2010

(65) Prior Publication Data

US 2010/0195850 A1 Aug. 5, 2010

(30) Foreign Application Priority Data

Feb. 5, 2009 (JP) ..... 2009-024697

(51) Int. Cl.
*H04R 17/02* (2006.01)

(52) U.S. Cl. ..... 381/178; 381/172

(58) Field of Classification Search ..... 381/111, 381/178, 174, 112, 113, 114, 191, 120, 172; 455/556.1; 361/232; 332/135
See application file for complete search history.

(56) References Cited

U.S. PATENT DOCUMENTS 2,771,584 A * 11/1956 Thomas ..... 332/135
7,580,533 B2 * 8/2009 Schwartz ..... 381/172
2006/0116159 A1 * 6/2006 Lin et al. ..... 455/556.1
2007/0274544 A1 * 11/2007 Takeuchi et al. ..... 381/174
2009/0091873 A1 * 4/2009 Horiguchi ..... 361/232

FOREIGN PATENT DOCUMENTS

JP 55-140400 1/1980

* cited by examiner

*Primary Examiner* — Yuwen Pan
*Assistant Examiner* — Phan Le
(74) *Attorney, Agent, or Firm* — Whitham Curtis Christofferson & Cook, PC

(57) ABSTRACT

A microphone includes: a needle-like electrode; an opposite electrode facing the needle-like electrode; a discharge section formed between the needle-like electrode and the opposite electrode; a high-frequency oscillating circuit including the discharge section and producing a high-frequency discharge at the discharge section; a sound wave introduction section through which a sound wave is introduced to the discharge section; and a modulated signal extracting unit that extracts a signal modulated, according to the sound wave oscillated by the high-frequency oscillating circuit and introduced to the discharge section. The high-frequency discharge is produced at the discharge section as the high-frequency oscillating circuit performs high-frequency oscillation with the discharge section between the needle-like electrode and the opposite electrode as a return path, and a frequency modulation is performed as an equivalent impedance of the discharge section changes according to the sound wave.

11 Claims, 6 Drawing Sheets

MICROPHONE

BACKGROUND OF THE INVENTION

1. Field of the Invention

The present invention relates to a microphone that can be formed without a diaphragm by using high-frequency discharge for electric acoustic conversion.

2. Description of the Related Art

Generally, electro-acoustic transducers such as microphones and speakers have a diaphragm. In a microphone, the diaphragm vibrates upon receiving a sound wave and the vibration is detected as an electromagnetic, a capacity, or an optical change to be converted into an electrical signal. In a general speaker, an acoustic signal is electromagnetically converted into a vibration of the diaphragm to be output as a sound wave. Thus, the diaphragm in electro-acoustic transducers is used to convert air vibration into an electric signal and vice versa. In other words, an acoustic system, a machine vibration system, and an electric circuit system of an electro-acoustic transducer are connected via a single diaphragm.

Designing of a microphone begins by setting a control method for the machine vibration system including the directivity of the microphone. Based oh the control method, a resonance frequency of the diaphragm is set and the acoustic circuit system and the electrical circuit system, are designed. Materials and the shape of the microphone are selected and designed to be most suitable for the control method. The control method for the machine vibration system includes mass control, resistance control, and elasticity control. The resonance frequency of the diaphragm is set to be at around the lower limit, the middle, and the higher limit of a main frequency band. A conventional general electro-acoustic transducer, especially a microphone, using any of the methods has a diaphragm. The diaphragm provided therein inevitably limits the frequency response. More specifically, even a diaphragm with the lowest mass provides inertial force to limit frequencies in which the sound can be collected.

In view of the above, an electro-acoustic transducer without a diaphragm is under study. For example, a microphone without a diaphragm is known that uses a laser to detect change in density of air due to a sound wave to convert the sound wave into an electrical signal. Various methods for detecting an acoustic pressure have been studied. Upon collecting sound, a velocity component of a sound wave should be detected together with the acoustic pressure. Among currently available microphones of various methods, a bidirectional microphone can detect the velocity component. Unfortunately, the bidirectional microphone also has a diaphragm, which limits frequencies at which the sound can be collected.

A method is available in which a hot-wire anemometer, which is formed with a semiconductor manufacturing technique, is used to detect the particle velocity of sound waves in the audible frequency. Here, because a degree to which the hot wire is cooled differs according to the particle velocity, the cooling degree can be detected as a resistance change. Unfortunately, as is apparent from the fact that a carbon microphone performs detection in a similar manner, a wide dynamic range is difficult to be obtained by this method.

As an example of a method to provide the electro-acoustic transducer without a diaphragm, Japanese Patent Application Publication No. S55-140400 discloses a method of detecting the particle velocity by using electrical discharge to perform electro-acoustic conversion. The invention disclosed in Japanese Patent Application Publication No. S55-140400 includes: a needle-like discharge electrode; an opposite electrode that surrounds the needle-like discharge electrode with a certain space therebetween. The opposite electrode is made of a conductive material and has a shape of a sphere having a hole through which a sound wave passes. The discharge electrode extends inside the opposite electrode having a sphere shape to roughly the center thereof. From a high-frequency voltage generating circuit, a high-frequency voltage signal, demodulated by a low frequency signal to be converted to a sound wave, is applied to the discharge electrode. Then, a corona discharge corresponding to the high-frequency voltage signal is produced between the discharge electrode and the opposite electrode so that the low frequency signal, i.e., the sound wave is radiated.

SUMMARY OF THE INVENTION

The invention disclosed in Japanese Patent Application Publication No. S55-1400400 relates to an ionic speaker that converts an electrode-acoustic signal into a sound wave by using an electrical discharge. Japanese Patent Application Publication No. S55-140400 does not disclose an invention that can be directly applied to a microphone, nor does it indicate possibility to use the invention for a microphone.

An object of the present invention is to provide a microphone that can be formed without a diaphragm by being able to convert a sound wave into an electrical signal by using an electrical discharge so that the frequency response is not limited.

According to an aspect of the present invention, a microphone includes: a needle-like electrode; an opposite electrode facing the needle-like electrode; a discharge section formed between the needle-like electrode and the opposite electrode; a high-frequency oscillating circuit including the discharge section and producing a high-frequency discharge at the discharge section; a sound wave introduction section through which a sound wave is introduced to the discharge section; and a modulated signal extracting unit that extracts a signal modulated, according to the sound wave oscillated by the high-frequency oscillating circuit and introduced to the discharge section.

In the microphone according to the aspect of the invention, preferably, the, high-frequency discharge is produced at the discharge section as the high-frequency oscillating circuit performs high-frequency oscillation with the discharge section between the needle-like electrode-and the opposite electrode as a return path, and a frequency modulation is performed as an equivalent impedance of the discharge section changes according to the sound wave.

The high-frequency oscillating circuit may have a tank coil between an active oscillation element and the discharge section, and a detection coil magnetically connected to the tank coil may form the modulated signal extracting unit.

The active oscillation element may be a vacuum tube and a plate of the vacuum tube may be connected to the discharge section via the tank coil. The discharge section is connected in a manner that a discharge current returns to a grid of the vacuum tube.

The discharge section is a part of the high-frequency oscillation circuit at which the high-frequency discharge is produced. When a sound wave is introduced to the discharge section while the high-frequency discharge is produced thereat, the equivalent impedance of the discharge section changes according to the sound wave. Thus, a high-frequency signal produced at the high-frequency oscillation circuit is modulated by the sound wave and the modulated signal is output. By demodulating the modulated signal, an acoustic signal can be obtained. In a manner described above, a sound wave can be converted into an electro-acoustic signal without a diaphragm. Accordingly, a microphone with a fine acoustic characteristic having no frequency response limit can be obtained.

DETAILED DESCRIPTION OF THE PREFERRED EMBODIMENTS

A microphone according to embodiments of the present invention is described below with accompanying drawings.

First Embodiment

Figure 1:
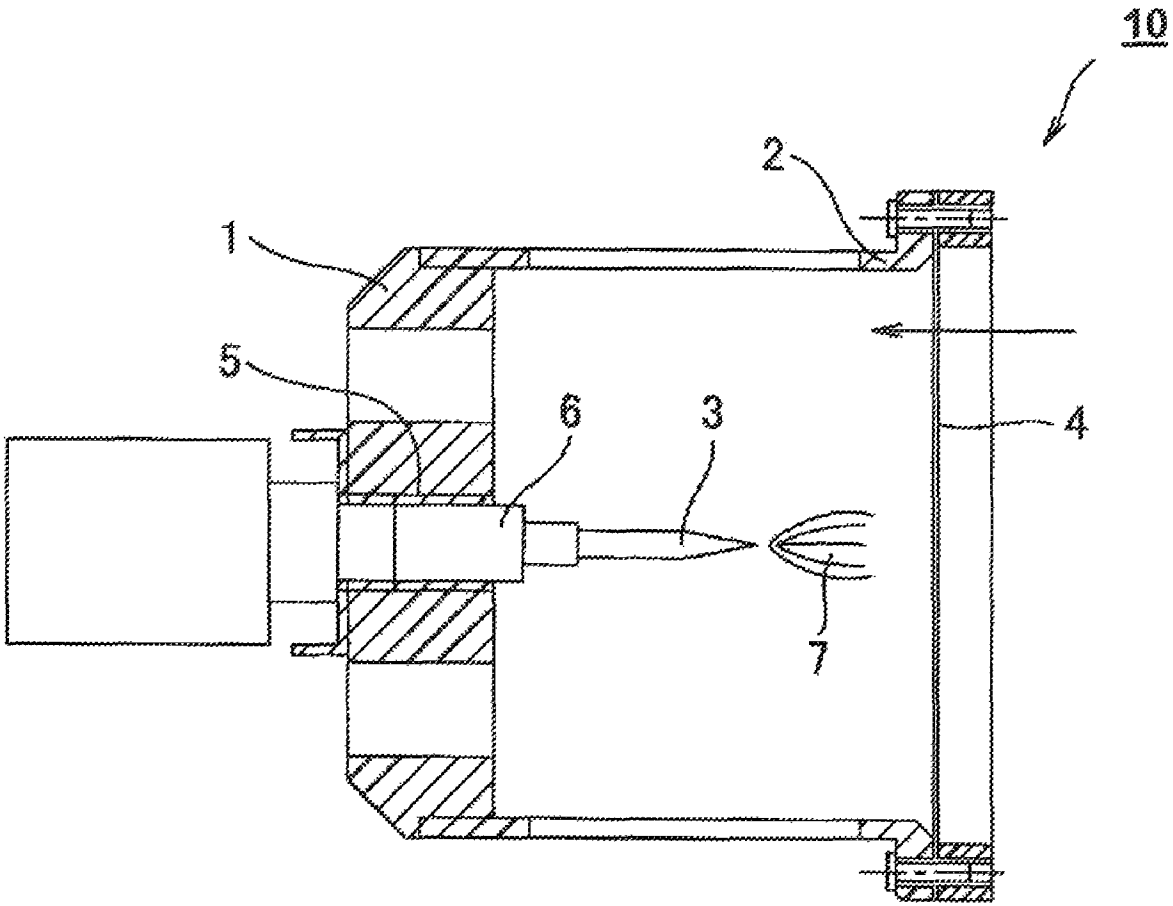
FIG. 1 is a longitudinal sectional view depicting a mechanical composition of a microphone according to an embodiment of the present invention.

FIG. 1 depicts a microphone unit section of a microphone according to a first embodiment of the present invention. In FIG. 1, this microphone unit 10 includes, as main elements, a needle-like electrode 3 and an opposite electrode 4 with which an electrical discharge is produced therebetween. The base of the needle-like electrode 3 is covered with a tubular insulating tube 6 fit in another tubular-insulating tube 5. The insulating tube 5 penetrates a base 1 in the thickness direction to be fit therein. Thus, the needle-like electrode 3 is fixed to the base 1 as the base of the needle-like electrode 3 penetrates the base 1 in the thickness direction via the insulating tubes 5 and 6. An end of a tubular case 2 fits the outer periphery of the base 1 to be fixed thereto. The case 2 extends to one side of the base 1. A tip of the needle-like electrode 3 extends in the extending direction of the case 2. The needle-like electrode 3 is positioned, inside an area surrounded by the case 2, substantially on the center axis of the case 2. In the present invention, the needle-like electrode 3 is a piece of tungsten of which the curvature radius of the tip is 50 micrometers.

An opposite electrode 4 is fixed to an opening end of the case 2 via an appropriate holder to cover the opening end opposite to the end fixed to the base 1. The opposite electrode 4, which is a plate electrode, is preferably formed of, for example, a perforated metal having a numerous pores or a conductive wire weaved into a net so that a sound wave can pass therethrough. A surface of the opposite electrode 4 is covered by an insulating material. In the present embodiment, the opposite electrode 4 is a stainless steel plate having a number of openings through which a sound wave passes and covered with a ceramic (silica) layer having a thickness of 0.1 millimeter. The needle-like electrode 3 and the opposite electrode 4 face each other with a certain space, which serves as a discharge section, therebetween. As will be described later, the discharge section is a part of a high-frequency oscillating circuit at which a high-frequency discharge (so called flame discharge) is produced. As shown in FIG. 1, a flame. 7 is produced due to the discharge at the discharge section between the needle-like electrode 3 and the opposite electrode 4. As described above, the opposite electrode 4 also serves as a sound wave introduction section through which a sound wave is introduced to the discharge section in the case 2. The sound wave introduction section is also formed in the peripheral wall of the case 2 in a form of a slit-like hole.

Figure 2:
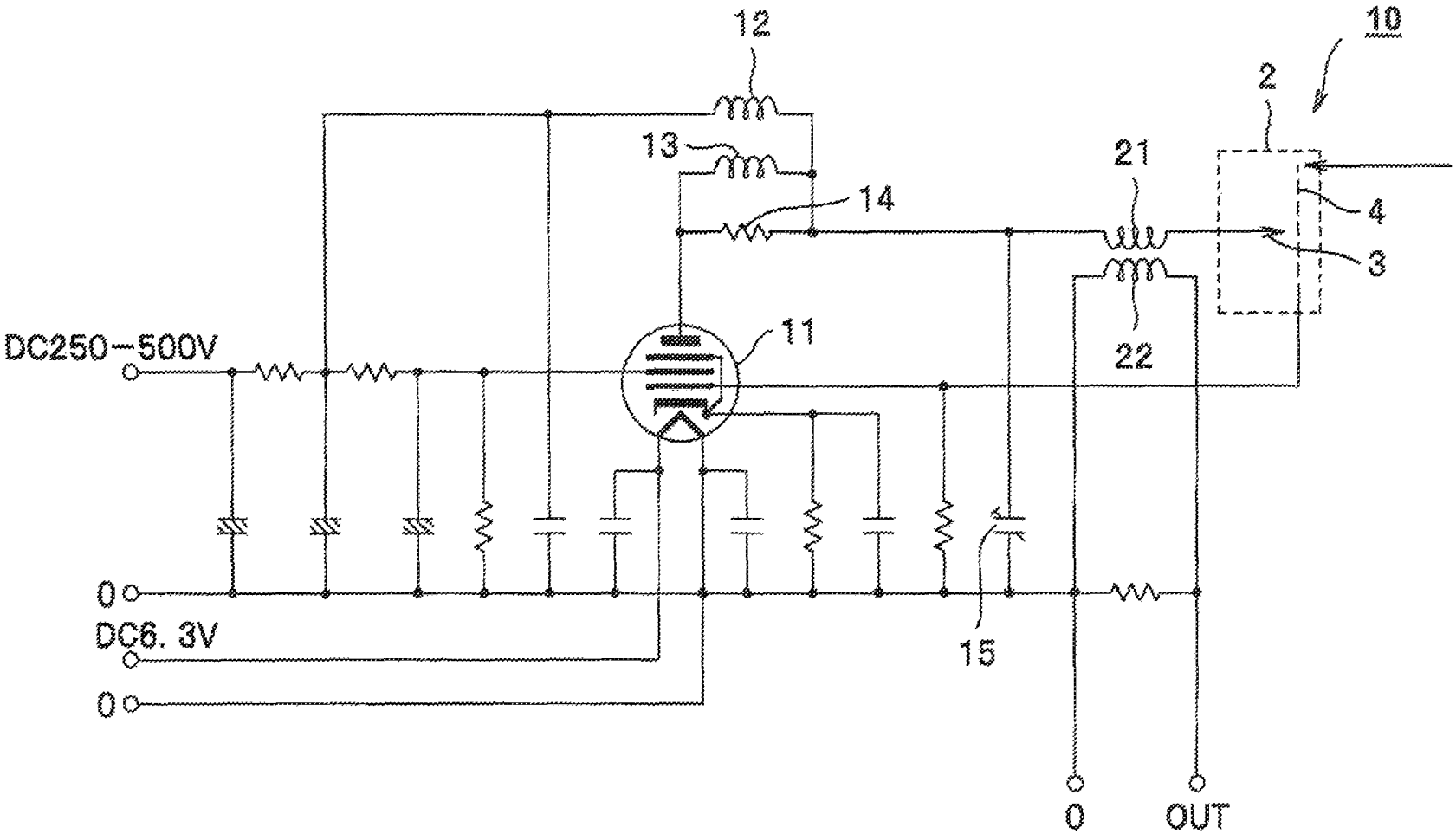
FIG. 2 is a circuit diagram depicting an exemplary circuit configuration of the microphone.

FIG. 2 depicts an embodiment of a microphone including the microphone unit 10 and a peripheral electric circuit connected to the microphone unit 10. A vacuum tube 11 shown in FIG. 2 is an active element serving as a-main element of the high-frequency oscillating circuit that produces a high-frequency discharge, between the needle-like electrode 3 and the opposite electrode 4. The vacuum tube 11, which is the active oscillation element, can endure high voltage required to produce the high-frequency discharge. In this example, the vacuum tube 11 is a pentode vacuum tube and DC power of 6.3 V is supplied to a heater thereof. Relatively high DC voltage of about 250 to 500 V is applied to a plate of the vacuum tube 11 via appropriate resistances, a choke coil 12, and a parasitic oscillation preventing coil 13. The resistances divide the high voltage to voltages suitable to be applied, as a bias voltage, to a second grid of the vacuum tube 11. Through resistances and a capacitor, the appropriate bias voltage is also applied to a cathode and a third grid of the vacuum 11.

The plate of the vacuum tube 11 is connected to the needle-like electrode 3 of the microphone unit 10 via a resistance 14 and a tank coil 21. The resistance 14 and the parasitic oscillation preventing coil 13 are connected in parallel. The opposite electrode 4 facing the needle-like electrode 3 is connected to a first grid of the vacuum tube 11. When the discharge starts at the discharge section formed between the needle-like electrode 3 and the opposite electrode 4, a discharge path formed between the needle-like electrode 3 and the opposite electrode 4 is connected to the first grid of the vacuum tube 11. Thus, the discharge current returns to the vacuum tube 11. By forming the return path while the vacuum tube 11 serves as the active element as described above, a self-oscillating high-frequency oscillation circuit is obtained. An oscillating frequency of the high-frequency oscillation circuit is determined based on an inductance of the tank coil 21; and a capacity between the needle-like electrode 3 and the opposite electrode 4. The oscillating frequency can be adjusted by varying a capacity of a variable-capacity capacitor 15 connected between: a connection point of the resistance 14 and the tank coil 21; and earth point. The oscillation frequency, which can be arbitrarily set, should be around 27 MHz considering a bandwidth of an audio signal. Hereinbelow, the discharge section is also referred to as "the high-frequency discharge section."

A sound wave is introduced to the high-frequency discharge section through the sound wave introduction section. The flame discharge at the high-frequency discharge section is influenced by the introduced sound wave. More specifically, particle velocity of the sound wave changes particle velocity of the high-frequency discharge section to change an equivalent impedance of the high-frequency discharge section. A signal sent from the oscillating circuit is modulated by the sound wave as the equivalent impedance of the high-frequency discharge section is changed by the sound wave. The modulated signal includes both a frequency-modulated (FM) component and an amplitude-modulated (AM) component. Because more FM components are included than the AM component, the FM signal extracted and input to a frequency demodulating circuit can be converted into an audio signal corresponding to the sound wave introduced through the sound wave introduction section.

Figure 3:
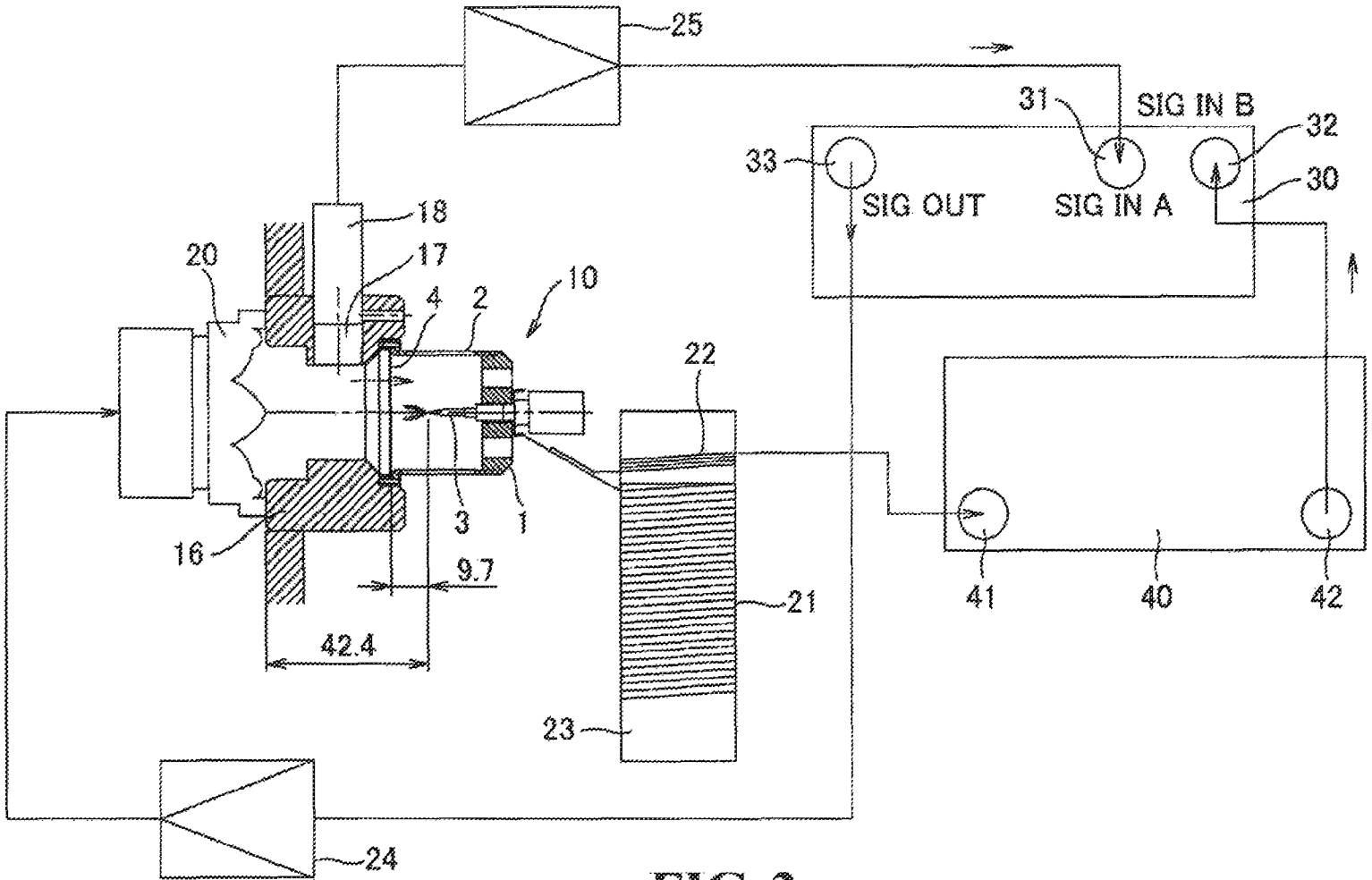
FIG. 3 is a schematic of a measurement system for confirming that the microphone according to the present invention works as designed.

In the embodiment shown in FIG. 2, a detection coil 22 magnetically coupled to the tank coil 21 serves as an extracting unit for the modulated signal. FIG. 3 exemplary depicts the detection coil 22 magnetically coupled to the tank coil 21. Here, a core 23 made of a magnetic material is wound by the tank coil 21 and the detection coil 22. The tank coil 21 serves as a first coil while the detection coil 22 serves as a second coil and the modulated signal is detected by the detection coil 22. As shown in FIG. 2, the two ends of the detection coil 22 are connected to an output terminal and earth point, respectively, both of which provide an output from the microphone. Because the output signal is the high-frequency signal modulated by the sound wave, the audio signal can be output by demodulating the output signal. The demodulation circuit therefor can be provided inside or outside the microphone.

To confirm that the microphone using the high-frequency discharge as described in the embodiment can actually be obtained, a measurement system as shown in FIG. 3 was formed. The microphone unit 10 formed as above was connected to a coupler 16 serving as a measurement jig. The coupler 16 has a hollow structure and the microphone unit 10 is mounted on a side thereof to block one end of the hollow, while a speaker 20 to produce a sound wave for measurement is mounted on the opposite side. A microphone 17 that detects a sound pressure is embedded in a hole provided on the coupler 16 to penetrate in the radial direction thereof. A sound wave introduction side of the microphone 17 faces the hollow. The microphone 17 has a preamplifier 18 for amplifying a detected signal. Depending on the type of the microphone 17 and the preamplifier 18, a power unit 25 is connected to the preamplifier 18 to supply power to the microphone 17. The power unit 25 also serves as a microphone amplifier. The connection is so designed that the detected signal from the microphone 17 is amplified by the preamplifier 18 and the power unit 25 and then input, as a sound pressure detected signal, to a first signal input terminal 31 of an audio analyzer 30.

One end of the tank coil 21 is connected to the needle-like electrode 3 of the microphone unit 10, and the opposite electrode 4 is connected to the first grid of the vacuum tube 11 as shown in FIG. 2. Thus, the high-frequency oscillating circuit is formed that is a self-oscillating circuit and has the discharge section as the return path as described above. As shown in FIG. 3, the output terminal of the detection coil 22 magnetically coupled to the tank coil 21 is connected to a signal input terminal 41 of an FM linear detector 40. The FM linear detector 40 can demodulate an FM signal and outputs, a frequency demodulated sound signal through an output terminal 42. The output terminal 42 is connected to a second signal input terminal 32 of an audio analyzer 30 so that the audio signal is sent thereto. A signal output terminal 33 of the audio analyzer 30 can output, for example, a sine wave signal of an audible frequency. The sine wave signal is fed into a power amplifier 24 that activates the speaker 20 with the sine, wave signal. In the measurement system, the distance from the tip of the needle-like electrode 3 of the microphone unit 10 to the opposite electrode 4 is 9.7 millimeters while the distance from the tip of the needle-like electrode 3 to a speaker mounting end of the coupler 16 is 42.4 millimeters.

The oscillation frequency of the high-frequency oscillation circuit set to be 28.225 MHz while the discharge is not produced at the discharge section fell to 28.178 MHz while the discharge is produced. Thus, an equivalent capacitance has been confirmed to increase when the discharge is produced at the discharge section. While the discharge was produced at the discharge section, the sine wave signal of an audible frequency was output through the output terminal 33 of the audio analyzer 30 to activate the speaker 20 via the power amplifier 24, and the sound wave corresponding to the sine wave signal was radiated into the coupler 16 from the speaker 20. A sound pressure within the coupler 16 is detected by the microphone 17 and the detected signal is fed into the first signal input terminal 31 of the audio analyzer 30 via, for example, the preamplifier 18. In the coupler 16, the sound wave is guided to the discharge section. The equivalent capacity of the discharge section is changed according to the particle velocity of the sound wave introduced thereto. Thus, the sound wave is frequency modulated (FM). The frequency modulation of the audio signal has been confirmed by detecting the frequency of a detected signal fed into the signal input terminal 41 of the FM linear detector 40 from the detection coil 22 magnetically connected, to the tank coil 21, which is a part of the high-frequency oscillation circuit. The FM linear detector 40 outputs the frequency demodulated audio signal through the output terminal 42. The audio signal and the sound pressure inside the coupler 16 were fed into the second signal input terminal 32 and the first signal input terminal 31, respectively of the audio analyzer 30 to analyze the correlation therebetween. As a result, the frequency demodulated signal has been confirmed to match the signal output from the output terminal 33 of the audio analyzer 30, which is the source of the sound radiated from the speaker 20.

Figure 4:
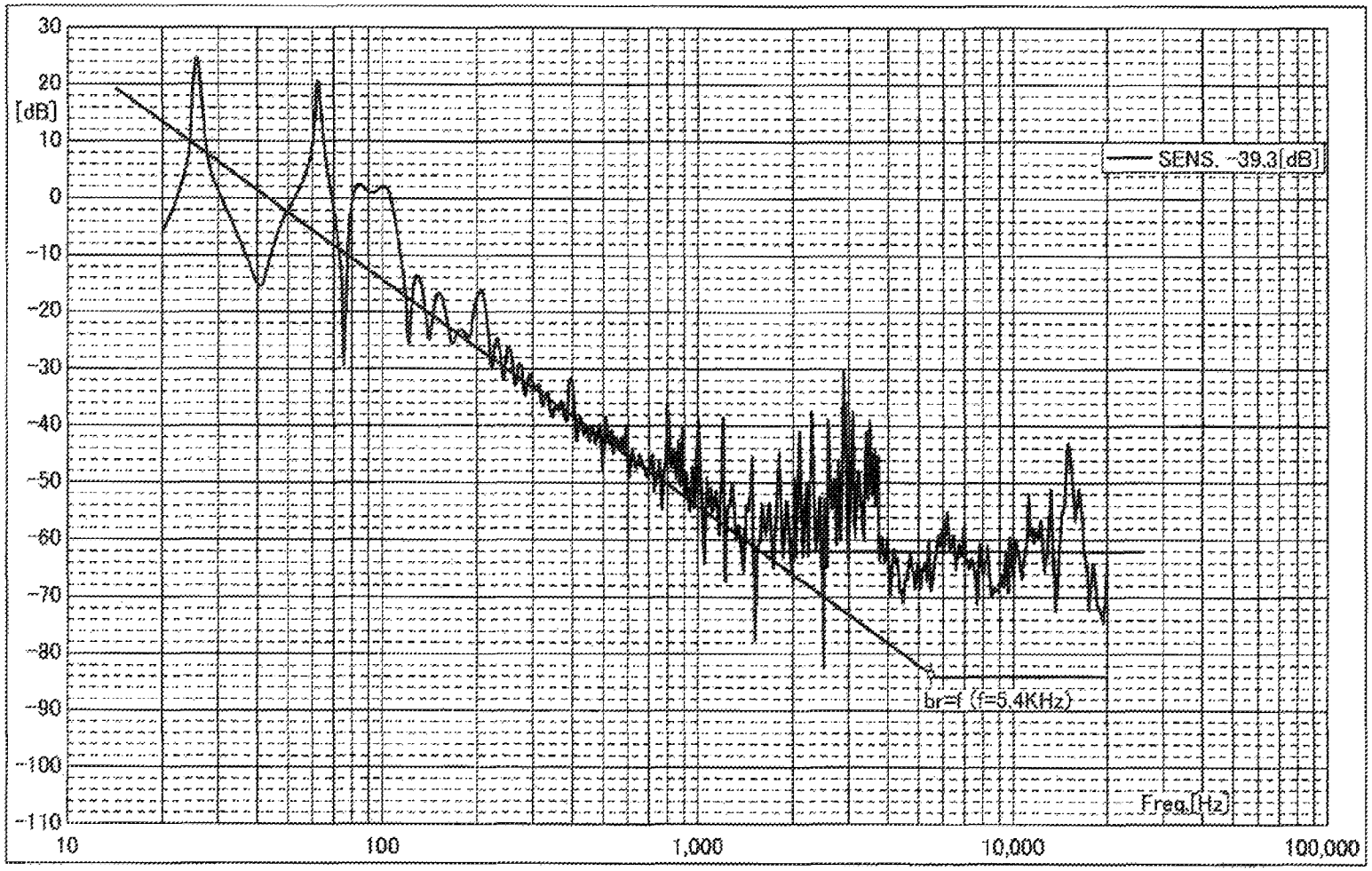
FIG. 4 is a graph depicting a result of measuring frequency response of the microphone according to the embodiment of the present invention with the measurement system.

FIG. 4 depicts a result of frequency response measurement performed by the measurement system shown in FIG. 3 upon applying the sound pressure of 94 dBSPL to the discharge section inside the coupler 16.

Figure 5:
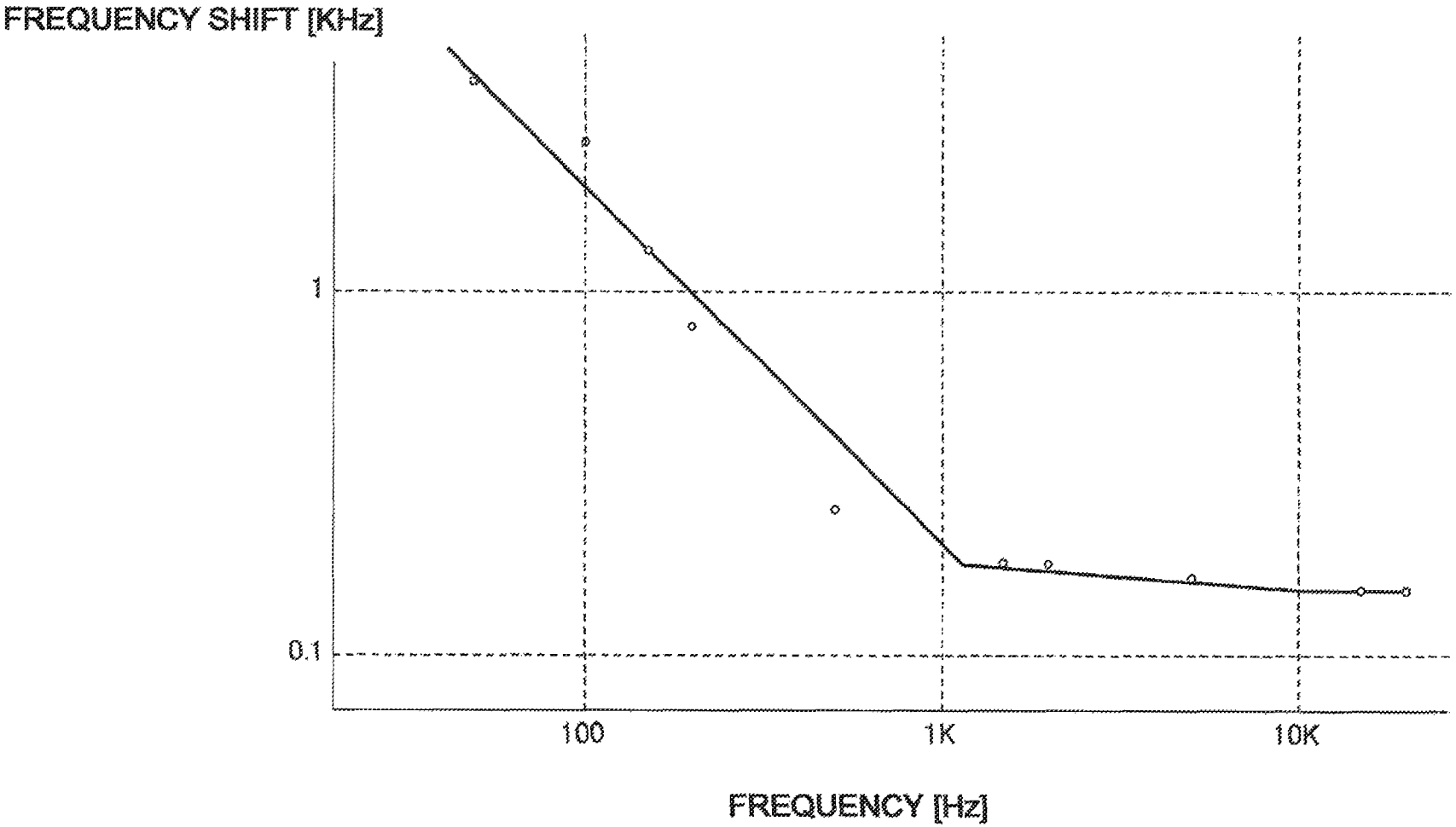
FIG. 5 is a graph depicting a result of measuring frequency shift of the microphone according to the embodiment of the present invention with the measurement system.

FIG. 5 depicts a result of frequency shift measurement performed by the measurement system. As shown in the measurement result shown in FIG. 5, particle Velocity components of a sound wave are detected up to a certain frequency. With frequencies equal to and higher than the certain frequency, a plane wave is formed supposedly because the distance from the opening of the coupler 16, that is, the microphone unit mounting end to the sound source becomes smaller. The frequency response in a plane wave sound field can be assumed to be flat.

All things considered, it has been confirmed that a microphone can be actually be obtained that can be formed without a diaphragm by using high-frequency discharge instead by the microphone including: the needle-like electrode 3; the opposite electrode 4 facing the needle-like electrode 3; the discharge section formed between the needle-like electrode 3 and the opposite electrode 4; the high-frequency oscillating circuit including the discharge section and producing the high-frequency discharge at the discharge section; the sound wave introduction section through which the sound wave is introduced to the discharge section; and the modulated signal extracting unit (the detection coil 22) that extracts a signal modulated according to a sound wave oscillated by the high-frequency oscillating circuit and introduced to the discharging unit.

Due to the configuration without a diaphragm, a microphone having no frequency limit can be obtained.

Second Embodiment

Figure 6:
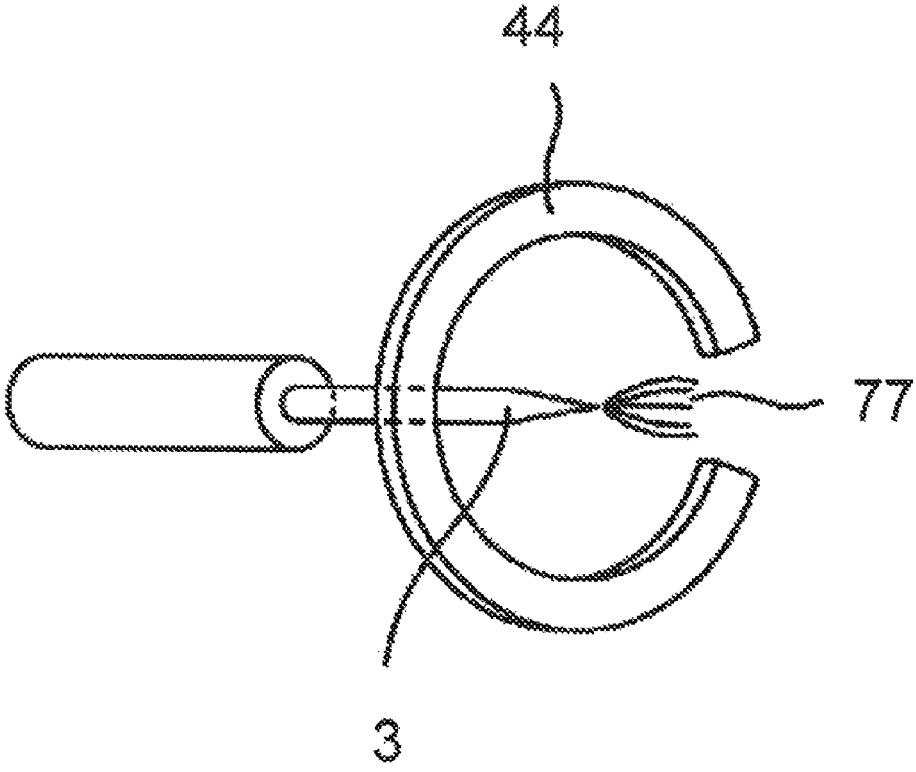
FIG. 6 is a perspective view schematically depicting key elements of a microphone according to another embodiment of the present invention.

A microphone according to a second embodiment of the present invention is described with reference to FIG. 6. Compared to the configuration in the first embodiment, the microphone according to the second embodiment is unique in the structure of the opposite electrode. Thus, FIG. 6 only depicts the opposite electrode and the needle-like electrode. The structure of the needle-like electrode in this embodiment is almost the same as that of the first embodiment, thereby the needle-like electrode is denoted by the reference numeral 3 in both embodiments. A discharge section is formed between the needle-like electrode 3 and the opposite electrode 44. The opposite electrode 44 has a shape of ring surrounding the needle-like electrode 3. Although FIG. 6 exemplary depicts the opposite electrode 44 partly cut out to be C-shaped, the opposite electrode may be complete ring-shaped. The surface of the opposite electrode 44 is covered with an insulating material. The needle-like electrode 3 and the opposite electrode 44 form the circuit similar to that shown in FIG. 2, thereby forming the high-frequency oscillating circuit having the discharge section as the return path.

The high-frequency oscillation circuit oscillates in the frequency corresponding to a capacity between the tip of the needle-like electrode 3 and the opposite electrode 44, and the inductance of the tank coil as described in the first embodiment, and generates high frequency discharge at the discharge section between the needle-like electrode 3 and the opposite electrode 44. A flame 77 is produced by the discharge. The equivalent impedance of the discharge section changes according to the particle velocity of a sound wave introduced thereto. The oscillation signal from the high-frequency oscillation circuit is modulated and output according to the sound wave introduced to the discharge section. Thus, the present embodiment shown in FIG. 6 provides the effect as same as that of the first embodiment.

The microphone according to the present invention, which has excellent frequency response, is advantageously used as a studio microphone. The microphone according to the present invention, which can precisely detect the change in the air, can also be used as, measurement devices, for example, an anemometer etc.

What is claimed is:

1. A microphone which lacks a diaphragm comprising:

a needle-like electrode;

an opposite electrode facing the needle-like electrode;

a discharge section formed between the needle-like electrode and the opposite electrode;

a high-frequency oscillating circuit including the discharge section and producing a high-frequency discharge at the discharge section;

a sound wave introduction section through which a sound wave is introduced to the discharge section and is oscillated by the high frequency oscillating circuit to produce an electrical signal without a diaphragm; and a modulated signal extracting unit that extracts the electrical signal modulated, according to the sound wave oscillated by the high-frequency oscillating circuit.

2. The microphone according to claim 1, wherein the high-frequency discharge is produced at the discharge section as the high-frequency oscillating circuit performs high-frequency oscillation with the discharge section between the needle-like electrode and the opposite electrode as a return path, and a frequency modulation is performed as an equivalent impedance of the discharge section changes according to the sound wave.

3. The microphone according to claim 2, wherein the equivalent impedance of the discharge section changes according to a particle velocity of the sound wave.

4. The microphone according to claim 1, wherein the opposite electrode is a plate electrode disposed in front the needle-like electrode.

5. The microphone according to claim 1, wherein the opposite electrode is a ring-shaped electrode disposed at a circumferential area of the needle-like electrode.

6. The microphone according, to claim 4, wherein a surface of the opposite electrode is covered with an insulating material.

7. The microphone according to claim 5, wherein a surface of the opposite electrode is covered with an insulating material.

8. The microphone according to claim 1, wherein the high-frequency oscillating circuit has a tank coil between an active oscillation element and the discharge section, and a detection coil magnetically connected to the tank coil forms the modulated signal extracting unit.

9. The microphone according to claim 1, wherein an FM signal is output from the modulated signal extracting unit.

10. The microphone according to claim 9, wherein the modulated signal extracting unit is connected to a frequency demodulation circuit with which the output from the modulated signal extracting unit is demodulated into an audio signal and output.

11. The microphone according to claim 8, wherein the active oscillation element is a vacuum tube, a plate of the vacuum tube is connected to the discharge section via the tank coil, and the discharge section is connected in a manner that a discharge current returns to a grid of the vacuum tube.

* * * * *